US006401768B2

(12) United States Patent
Lichte et al.

(10) Patent No.: US 6,401,768 B2
(45) Date of Patent: Jun. 11, 2002

(54) METHOD AND CONFIGURATION FOR TRANSPORTING ELECTRICALLY CONDUCTIVE PAINT

(75) Inventors: Joachim Lichte, Rockenberg-Ot Oppertshofen; Thomas Börner, Butzbach, both of (DE)

(73) Assignee: ABB Patent GmbH, Ladenburg (DE)

( * ) Notice: Subject to any disclaimer, the term of this patent is extended or adjusted under 35 U.S.C. 154(b) by 0 days.

(21) Appl. No.: 09/843,516

(22) Filed: Apr. 26, 2001

Related U.S. Application Data

(63) Continuation of application No. PCT/EP00/08254, filed on Aug. 24, 2000.

(51) Int. Cl.[7] ..... B65B 1/04; B65B 3/04

(52) U.S. Cl. ..... 141/2; 141/18; 141/129; 141/153; 141/168; 239/3; 239/690

(58) Field of Search ..... 141/2, 9, 18, 129, 141/100, 104, 105, 153, 168; 239/3, 690, 303; 427/421, 445

(56) References Cited

U.S. PATENT DOCUMENTS 4,792,092 A * 12/1988 Elberson et al. ..... 239/112
4,827,993 A * 5/1989 Ito et al. ..... 141/104
4,932,589 A * 6/1990 Diana ..... 118/302
5,326,031 A * 7/1994 Konieczynski ..... 239/3

* cited by examiner

*Primary Examiner*—Timothy L. Maust
(74) *Attorney, Agent, or Firm*—Laurence A. Greenberg; Werner H. Stemer; Gregory L. Mayback

(57) ABSTRACT

A method and a configuration are provided for transporting electrically conductive paint from a point at earth potential to at least one paint application device which is at a high voltage potential. A needed quantity of paint is filled into a cartridge at a point at earth potential. The filled cartridge is conveyed by a first conveying device to a second conveying device. The cartridges are then allocated to workpieces to be painted. The filled cartridge is transported by the second conveying device to the at least one paint application device. At the paint application device, the cartridge is connected to at least one spray head. The emptied cartridge is transported by the second conveying device to a third conveying device, and the third conveying device transports the cartridge back to the loading station, while a further cartridge is filled there and conveyed by the first conveying device.

32 Claims, 2 Drawing Sheets

METHOD AND CONFIGURATION FOR TRANSPORTING ELECTRICALLY CONDUCTIVE PAINT

CROSS-REFERENCE TO RELATED APPLICATION

This application is a continuation of copending International Application No. PCT/EP00/08254, filed Aug. 24, 2000, which designated the United States.

BACKGROUND OF THE INVENTION

Field of the Invention

The invention relates to a method and a configuration for transporting electrically conductive paint.

Painting methods are used in an extremely wide range of configurations when many identical work pieces, for example car bodies in automobile manufacturing, have to be painted. The painting methods are automated to the greatest possible extent, in order to achieve the highest possible throughput of workpieces. Conventional conveying speeds in automobile manufacturing on a production line are 2.5 m/s to 10 m/s. To this end, it is necessary to carry out a color change within 10 to 15 seconds in these painting methods.

In order to be able to meet such time constraints for a color change, the different colors are normally pumped around from a paint tank in a ring line in each case. From these ring lines, branch lines lead to a battery of valves frequently equipped as a color-change block, which then selects the chosen color and feeds the paint to a line which is connected to the paint application device. In order to shorten the times for a color change further, the battery of valves and the line to the paint application device are provided in duplicate and installed in such a way that they can be operated in parallel. The color-change block is provided as close as possible to the paint application device, in order to configure the branch lines in which the color may also sit for a relatively long time, that is to say, cannot be pumped around, to be as short as possible.

Paint tanks and paint application device are normally provided physically far from one another. Accordingly, the ring lines between the paint tank and the paint application device are often very long.

In such methods, the number of colors is restricted to normally 25 colors, since for each color a circulation line is installed and the installation outlay for further colors, which are then often also used less frequently, is no longer justified economically.

A further aspect is that during the color change there are paint losses, in particular as a result of the cleaning of the paint line between the color-change block and the paint application device, which is done before the next paint of a different color is led into the paint line. In order to minimize such paint losses, in recent times so-called scrapers or "pigs" have been used. These force the greatest possible volume of paint in the paint line back into the associated branch line for the relevant color, before the cleaning of the paint line is carried out.

The workpieces to be painted are often transported to a painting area by a conveying device and, after the painting operation, are transported out of this area again. The painting operation can also be carried out during the transport within a specific area, so that the workpieces to be painted are moved continuously.

Consequently, the painting areas are configured in different ways and provided with different paint application devices. For example, the painting area can be configured as a stationary painting cubicle. An example of a paint application device is a paint atomizer. In addition, stationary painting robots with a paint atomizer moved by the robot are also used as a paint application device. In addition, painting robots which travel along in the painting area are also used as a paint application device.

Depending on the requirement, the paint or lacquer has to be applied in layers in a number of steps, and to some extent, the different paints are also applied one above another, for example firstly a primer, then a colored paint or lacquer and finally a clear lacquer as a topcoat. The layers are then normally applied by the appropriate paint application devices in successive painting areas and baked on in drying ovens.

In addition, the painting technique used differs significantly, depending on the given boundary conditions. Initially, predominantly paints based on solvents were used. Since these paints have only a low electrical conductivity, high-voltage methods with a so-called direct charging are often used without problems here. The paint application device, including the paint in the painting area, is in this case placed under a high voltage of up to 50 kV, so that the atomized paint particles carry an electrical charge. The workpiece to be painted is connected to ground potential. The paint particles are therefore attracted by the workpiece to be painted, as a result of the electrical attraction force, and in this way the utilization of paint is considerably increased.

In the case of painting with modern, environmentally friendly water-based paints, direct charging with high voltage is not possible, since the water-based paints are electrically conductive, and the high voltage would be dissipated via the paint. However, in order to increase the utilization of paint through the use of direct high-voltage charging here too, the supply of paint has to be isolated electrically from the paint application device. If this is not possible, the charging of the paint particles can also be achieved to some extent through the use of so-called external charging electrodes. Only in flight are the paint particles charged up in the electrical field between the electrodes and the workpiece. The insulating effect of the air prevents a high-voltage discharge taking place via the water-based paint.

SUMMARY OF THE INVENTION

It is accordingly an object of the invention to provide a method and a configuration for transporting electrically conductive paint which overcome the above-mentioned disadvantages of the heretofore-known methods and configurations of this general type and through the use of which the supply of electrically conductive paint to the paint application device is improved under the required high-voltage isolation conditions, without reducing the quality of the paint or reducing the variety of colors.

With the foregoing and other objects in view there is provided, in accordance with the invention, a method of transporting electrically conductive paint, the method includes the steps of:

- filling a required quantity of an electrically conductive paint into a cartridge at a location at ground potential, the location at ground potential serving as a loading station;
- transporting the cartridge filled with the electrically conductive paint with a first conveying device to a second conveying device;
- transporting the cartridge filled with the electrically conductive paint with the second conveying device to at least one paint application device at a high potential;

connecting, at the paint application device, the cartridge to at least one spray head provided at the at least one paint application device;

transporting an at least partly emptied cartridge with the second conveying device to a third conveying device;

transporting the at least partly emptied cartridge with the third conveying device back to the loading station;

filling a further cartridge at the location at ground potential; and conveying the further cartridge with the first conveying device.

An advantageous mode of the invention includes the steps of filling the further cartridge at the location at ground potential while simultaneously transporting the at least partly emptied cartridge back to the location at ground potential.

Another mode of the invention includes the steps of removing the cartridge filled with the electrically conductive paint from the second conveying device by using a moving device, moving the cartridge filled with the electrically conductive paint to the paint application device, and moving the at least partly emptied cartridge from the at least one paint application device onto the second conveying device by using the moving device or a further moving device.

An advantageous mode of the invention includes the steps of transferring a filled cartridge for each of a plurality of workpieces and for each of the at least one paint application device to a first position in the second conveying device, and transferring an at least partly emptied cartridge to a second position in the second conveying device.

At a point at earth potential, the paint to be transported is put into cartridges with an integrated piston, which is guided in the respective cartridge and is matched to the volume of paint present or desired. This area around this point or location will be referred to below as a loading station, since, in addition to a device for filling cartridges, it may have still further devices which help to favorably configure the method sequence. The loading station is advantageously provided in or close to a color mixing room. As a result, the so-called circulation lines, in which paint circulates between paint tank and color-change block, are advantageously short for paint of the different colors, a color change can be carried out simply, and the flushing of the ring line is simplified and shortened and flushing agent is saved. The number of possible colors is not restricted by the transport method of the paint. The cartridge therefore avoids paint having to be pumped around continuously in long ring lines, since pumping around reduces the paint quality and continuously needs power for the pumps. The size of the cartridge or its degree of filling is matched to the painting task, so that only comparatively small paint volumes are used and moved. This reduces paint losses in the event of contamination, the safety risk in the case of leakages is correspondingly low, and the material investment in the filling volumes is particularly low.

According to the invention, paint of a selected hue or color is put into a cartridge in the loading station and moved to a first conveying device. The first conveying device transports the filled cartridge to a second conveying device and is transferred to the latter. It is particularly advantageous if the second conveying device also transports the workpieces, for example on so-called product carriers.

The cartridge is transported onwards by the second conveying device into the high-voltage area and to the paint application device. An electrical connection between the first and second conveying device is advantageously avoided. At the paint application device, the cartridge is connected to the spray head or atomizer and the painting operation can begin. At the end of the application of paint, the cartridge is ideally completely empty. However, a small residue can also remain in the cartridge as security or reserve.

The now completely or partly empty cartridge is returned to the second conveying device again, with which it moves out of the high-voltage area as far as a third conveying device. The cartridge is transferred to the third conveying device and conveyed back to the loading station. In the loading station, the cartridge is fed to its further use.

The method sequence is particularly advantageous in terms of time if there is at the paint application device a transfer device which transfers filled cartridges from the second conveying device to the paint application device, which is set up to be electrically insulated, and after the painting operation, returns the cartridges from the paint application device to the second conveying device.

Still more advantageous are two transfer devices, the first transfer device removing the cartridges from the second conveying device, and the second transfer device returning the cartridges to the second conveying device.

A beneficial method sequence takes place if the filled cartridges are transferred by the first conveying device to a first position on the second conveying device. At the first position, there are then always filled cartridges. The cartridges which are transferred by the transfer device to the second conveying device at the paint application device are placed at a second position. Here, therefore, there are always cartridges which have been used.

With the objects of the invention in view there is also provided, a configuration for transporting electrically conductive paint, including:

a loading station configured for loading cartridges to be used for transporting paint, the loading station being a location at ground potential;

a paint application device at a high potential;

a first conveying device operatively connected to the loading station;

a second conveying device operatively connected to the first conveying device;

a third conveying device operatively connected to the second conveying device;

the first conveying device being configured for conveying filled cartridges from the loading station to the second conveying device;

the second conveying device being configured for conveying the filled cartridges to the paint application device, and for conveying at least partly emptied cartridges from the paint application device to the third conveying device;

the third conveying device being configured for conveying the at least partly emptied cartridges to the loading station; and an electronic control device, operatively connected to at least one of the first conveying device, the second conveying device, the third conveying device, the loading station, and the paint application device, for at least partly controlling a paint transport.

According to another feature of the invention, the loading station has at least one loading place connected to the first conveying device and the third conveying device, a filling device for filling cartridges, and a loading/unloading device for inserting cartridges into the first conveying devices and removing cartridges from the third conveying devices.

According to yet another feature of the invention, a reservoir is connected to the loading station, and the loading station has devices for storing and sorting filled cartridges, for magazining cartridges, for cleaning at least partly emptied cartridges, for testing cartridges for damage, for conveying residual paint back into the reservoir, for taking back at least partly emptied cartridges, and for rotating and/or moving cartridges.

According to a further feature of the invention, the reservoir is a spur line.

According to another feature of the invention, a reservoir is connected to the loading station, and the loading station has a loading place with devices for storing and sorting filled cartridges, for magazining cartridges, for cleaning at least partly emptied cartridges, for testing cartridges for damage, for conveying residual paint back into the reservoir, for taking back at least partly emptied cartridges, and for rotating and/or moving cartridges.

According to yet another feature of the invention, the first conveying device, the second conveying device, and the third conveying device are continuous conveyors for transporting the cartridges.

According to an alternative feature of the invention, the first conveying device, the second conveying device, and the third conveying device are intermittent conveyors, the intermittent conveyors perform a conveying operation only on demand when a cartridge is to be conveyed.

According to another feature of the invention, the first conveying device, the second conveying device, and the third conveying device are a combination of continuous conveyors and intermittent conveyors.

According to a further feature of the invention, the second conveying device is a transport device for transporting workpieces.

According to another feature of the invention, the second conveying device includes workpiece carriers.

According to another feature of the invention, the second conveying device transports workpieces and has a first position per each of the workpieces and per each of the paint application devices, the second conveying device further has a second position per each of the workpieces and per each of the paint application devices, and the first position is provided for a filled cartridge, the second position is provided for an at least partly emptied cartridge.

According to yet another feature of the invention, the paint application device has a transfer device for transferring cartridges to and from the second conveying device, the first position and the second position respectively disposed as close as possible to the transfer device when transferring the cartridges, and the second conveying device defines a transport direction, the first position is, as seen in the transport direction, in front of the second position.

According to another feature of the invention, a transfer device defines a transfer point for transferring cartridges from the first conveying device to the second conveying device. A storing device for storing cartridges, a sorting device for sorting cartridges, and/or a magazining device for magazining cartridges are disposed at the transfer point.

According to yet another feature of the invention, the paint application device has at least one metering device for conveying paint out of a cartridge.

According to a further feature of the invention, the paint application device has at least one transfer device for transferring cartridges from the second conveying device to the paint application device and/or at least one transfer device for transferring cartridges from the paint application device to the second conveying device.

According to another feature of the invention, the second conveying device is operated such that cartridges are transferred to the second conveying device in a sequence corresponding to a sequence of use during an application of paint.

According to another feature of the invention, the electronic control device is an automatic control device for coordinating a paint selection, color sequences, and operation sequences for the loading station, the first conveying device, the second conveying device, and/or the third conveying device.

According to an advantageous feature of the invention, the electronic control device-operates based on a fuzzy logic.

According to another feature of the invention, the electronic control device takes into account service lives or "pot lives" of paints of different colors in respective cartridges and optimizes an operation sequence based on the service lives. The electronic control device may be a component in an overall control device for controlling a supplying of the paint or may be configured for performing an overall control.

According to yet another feature of the invention, the electronic control device learns and adapts parameters automatically based on operating data collected and evaluated during an operating time.

With the objects of the invention in view there is also provided, a configuration for transporting electrically conductive paint, including:

cartridges for transporting paint, the cartridges having respective pistons, the pistons being movable to respective positions in the cartridges for matching respective paint volumes in the cartridges;

a loading station configured for loading the cartridges to be used for transporting paint, the loading station being a location at ground potential;

a paint application device at a high potential;

a first conveying device operatively connected to the loading station;

a second conveying device operatively connected to the first conveying device;

a third conveying device operatively connected to the second conveying device;

the first conveying device being configured for conveying filled ones of the cartridges from the loading station to the second conveying device;

the second conveying device being configured for conveying the filled ones of the cartridges to the paint application device, and for conveying at least partly emptied ones of the cartridges from the paint application device to the third conveying device;

the third conveying device being configured for conveying the at least partly emptied ones of the cartridges to the loading station; and an electronic control device, operatively connected to at least one of the first conveying device, the second conveying device, the third conveying device, the loading station, and the paint application device, for at least partly controlling a paint transport. Preferably, each of the cartridges is assigned a unique identification code.

In order to implement the method of the invention, a configuration is provided which, beneficially, has a loading station at a point at earth potential. There is a first conveying device, which transports cartridges from the loading station to a second conveying device. The second conveying device conveys the cartridges to the paint application device in the high-voltage area and, after the painting operation, out of the high-voltage area again to a third conveying device. The third conveying device transports the cartridge back to the loading station. In order to coordinate the individual parts of the configuration, there is a control device.

The loading station is advantageously equipped with a loading place, which is connected to the first and third conveying devices, and also with a device for filling the cartridges. In order to transfer and to remove cartridges between the conveying devices and the loading place, a device is provided.

This device will often transfer the cartridge to the first conveying device and remove cartridges from the third conveying device, but it is also conceivable that the first conveying device itself will accept the cartridge from the loading station through the use of a device and, in a corresponding way, cartridges will be transferred to the loading place by the third conveying device.

According to the invention, a number of loading places is also provided. This advantageously increases the capacity of the loading station or the working speed of the configuration or both.

In a particularly beneficial configuration, the loading station has various devices, for example a device for storing cartridges. A number of cartridges are filled with a specific color or hue. In the event of the next requirement for a cartridge of this hue, a cartridge from the storage will be used. In spite of a color change, no cleaning operation takes place. A further advantageous device sorts stored cartridges in accordance with a requirement, for example in accordance with a sequence of hues.

A device for magazining cartridges shortens the time for the method and helps provide the quickest possible method sequence.

Faulty, worn cartridges are detected and sorted out in a testing device. The risk of paint loss and contamination with paint is advantageously reduced.

Any existing residual paint can be returned into a reservoir, for example into the spur line, through the use of a device. Here, the advantage resides in the saving of paint.

If a device for rotating or moving cartridges is used, this prevents or reduces the sedimentation of the paint, which is reflected beneficially in the event of a relatively long pause in processing the paint.

In an advantageous case, the first conveying device is a continuous conveyor, for example a conveyor belt, which, as soon as the cartridge has been moved to the conveying device, immediately transports it to a point at which there is a second conveying device.

It is also regularly possible for intermittent conveyors to be used, for example grippers, which always transport one or more cartridges only when the latter have been filled and a requirement has been reported by a control device. Intermittent conveyors are used particularly advantageously when, for example, the sequence of cartridges is set up during the conveying operation or the distance between the loading station and second conveying device is small.

At the first transfer point, at which cartridges are moved from the first to the second conveying device, for example on the product carriers with workpieces, that is to say the cartridges are in turn transferred or accepted there, there is advantageously a transfer device. However, there may be still further devices, such as those for storing, for sorting or for magazining. These devices are useful when optimizing the method to the individual application.

The second conveying device is again a continuous or intermittent conveyor and transports the cartridges to the paint application device.

The cartridges are normally encoded. The control device allocates the cartridges to the workpieces. The cartridges may also be present in a specific sequence. The allocation of cartridges to workpiece then resides in the sequence itself.

It is particularly advantageous if the second conveying device used is the transport system of the workpieces to be painted, and the cartridges are allocated to the workpieces. In this way, the cartridges move together with the workpiece into the high-voltage area. Additional measures for electrical insulation are advantageously unnecessary if a painting robot takes the cartridges over from the second conveying device into a high-voltage insulated painting position.

In an advantageous configuration of the configuration, a first position for filled cartridges and a second position for completely or partly emptied cartridges is provided on the product carrier. With the position of the cartridges on the product carrier, the allocation to the workpiece is unique.

The second conveying device transports the filled cartridges as far as an acceptance point at the paint application device and is moved into a metering device provided there. The corresponding transfer device can be allocated to the paint application device, but also to the conveying system. In any case, it is integrated into the process sequence by the control device.

In order to implement short color-change times, a configuration having two metering devices is beneficial. These are then used alternately. One is activated and discharges the paint while the other is prepared for its next use. A subsequent color change then takes place particularly quickly.

At the paint application device there are one or more spray heads or atomizers, which, in the ideal case, consume the paint completely as a result of the painting. Otherwise, a paint residue remains in the cartridge. Paint residues in the lines are put back into the cartridge again by a device, for example a scraping device or "pig."

The cartridge which has therefore either been completely or partly emptied is removed from the relevant metering device by an output device and moved back to the first position on the second conveying device.

This is particularly advantageous to move the empty or partly emptied cartridge to a second position on the second conveying device. The maximum time between the removal and output of a cartridge from and to the second conveying device results if the first position is provided as far forward as possible in the transport direction, and the second position is provided as far back as possible in the transport area of the workpiece. The filled cartridge is then so to speak carried in front of the workpiece and is available early, and the completely or partly emptied cartridge is so to speak carried behind the workpiece and deposited at the second position as late as possible.

Using the second conveying device, the cartridges are transported as far as a point outside the high-voltage area, at which point they are moved from the second to a third conveying device. This is beneficially carried out by a transfer device which can advantageously be configured like the transfer device between the first and second conveying devices.

In principle, the same requirements as on the first conveying device are placed on the third conveying device. To this extent, it is advantageous to choose the same conveying principle. Otherwise, both continuous and intermittent conveyors are suitable for conveying the cartridges back to the loading station.

According to the invention, any desired combinations for the first, second and third conveying devices of continuous and intermittent conveyors are suitable as configurations of the configuration for implementing the transport method.

In the loading station, cartridges are cleaned, tested, stored and/or sorted, depending on their equipment. The loading station is beneficially provided in or close to the so-called color mixing room. All the essential devices for the acceptance of the paint when it is delivered up to putting paint into cartridges are provided physically close to one another. Optimization of the configuration is accordingly easily carried out.

If the shortest possible times are to be achieved between the dispatch of individual cartridges, or cartridges are to be dispatched to different receiving stations, both the method according to the invention and the individual configurations according to the invention which are involved in the method can advantageously be configured easily in accordance with the corresponding painting task.

A control device coordinates the individual method steps in a simple case through the use of a defined control sequence. Furthermore, for example, control signals from other control devices are processed, for example from the conveying device of the workpieces or a system which predefines the color sequence.

The control task is particularly advantageously carried out by a control device which is based on fuzzy logic. In particular, if the control device has to fulfil particularly complex tasks, a fuzzy logic control system is used instead of a previously conventional control system using numerical values based on differential equations for physical relationships. This is the case, for example, when the service time of the paints also has to be taken into account by the control device. This depends, inter alia, on the color, the specific cartridge, the frequency with which the specific cartridge has been used, etc. These parameters are registered and assessed by the fuzzy-logic control device, and then those cartridges which are close to the end of their service time are preferably used, or cartridges which have exceeded their service time are fed to the cleaning step.

Other features which are considered as characteristic for the invention are set forth in the appended claims.

Although the invention is illustrated and described herein as embodied in a method and a configuration for transporting electrically conductive paint, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
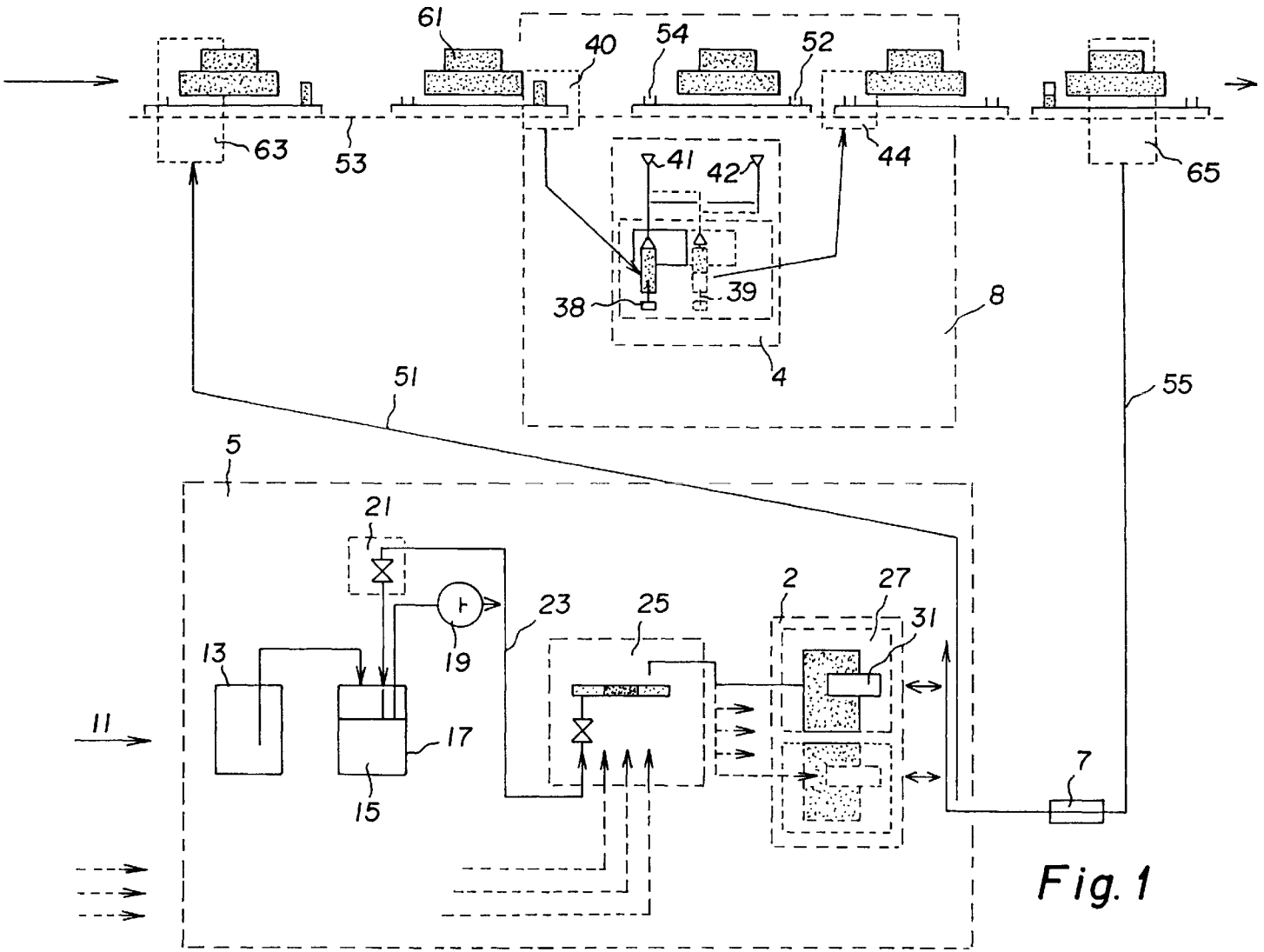
FIG. 1 is a schematic layout of an advantageous configuration for transporting electrically conductive paint for painting car bodies according to the invention.

Referring now to the figures of the drawings in detail and first, particularly, to FIG. 1 thereof, there is shown how a delivery 11 of paint is carried out in containers 13 with paint of different colors 15, into a color-mixing room 5. The paints supplied are put from the containers 13 into circulation tanks 17 allocated to the colors 15 and initially stored there. In each case, a circulation line is connected to each of these circulation tanks 17.

The stored paint is conveyed out of the respective circulation tank 17, in the event that paint of this color 15 is needed, through the use of a pump 19 allocated to each circulation line, and pumped through the circulation line, via a throttling element or valve element 21 in the ring line, back into the same circulation tank 17. For each of the circulation lines, a spur line leads to a color-change block 25. On the inlet side, the latter has at least as many shutoff elements as there are spur lines connected. On the output side, the color-change block 25 is connected via a line to a loading station 2.

The containers 13, the circulation tanks 17, the color-change block 25, the loading station 2 and the associated pipelines and other components are provided in a color-mixing room 5. The loading station 2 has a number of identical loading places 27. The number is given by the capacity of the loading station 2 required to be able to fill cartridges 7. The loading place 27 has a filling device 31.

Each loading place 27 fulfils the function of loading a cleaned or new cartridge 7, filling a cartridge 7 with paint, moving filled cartridges 7 to a first conveying device 51 and also receiving completely or partly emptied cartridges 7. The loading places 27 are provided such that a filled cartridge 7 passes onto a first conveying device 51 as a result of being moved out of its filling device 31.

The first conveying device 51 reaches as far as a first transfer point 63 outside a high-voltage area 8 to a second conveying device 53 and places the cartridge 7 onto a first position 52 on the second conveying device 53. The second conveying device 53 also transports the workpieces 61 to be painted, that is to say together with the cartridge 7, into the high-voltage area 8. In the high-voltage area 8 there is provided a paint application device 4, which has a device at an acceptance point 40. The paint application device 4 has two metering devices 38, 39 which accept cartridges 7. Both are connected to spray heads 41, 42 by paint lines and are optionally supplied with paint from cartridges 7 from one of the metering devices 38, 39.

The completely or partly emptied cartridges 7 are moved onto the second conveying device 53 from the corresponding metering device 38, 39 at an output point 44 onto a second position 54 at the painted workpiece 61. The second conveying device 53 transports the painted workpieces 61, together with completely or partly emptied cartridges 7, out of the high-voltage area 8 again. At a second transfer point 65, the completely or partly emptied cartridge 7 is moved out of its second position 54 onto a third conveying device, which leads back to the loading station 2.

The following operations are carried out in this configuration. Firstly, a delivery 11 of paint in a container 17 takes places into the color-mixing room 5 as close as possible to the paint tank 17 of the relevant color 15. The container 13 is lifted by a hoist and tipped into the paint tank 17, which is open at the top. Emptied containers 13 are then moved out of the color-mixing room 5, in order to make space for possible new deliveries 13 of further containers 13.

If a specific color 15 is then required by a paint application device 14, a control device coordinates the following for this color 15. The pump 19 is switched on and the throttling element 21 is opened, so that the paint is pumped around in the corresponding circulation line. The color-change block 25 then opens its throttling element 21 allocated to this color, so that the paint passes through the color-change block 25 and through the line leading onwards to the loading places 27 of the loading station 2.

A new or cleaned cartridge 7 is moved into the filling device 31 and connected to the line leading onwards. The cartridge 7 is then filled, until it is filled completely or the control device stops the filling operation at a filling quantity according to a program.

The filled cartridge 7 is moved by a device belonging to the loading place 27 onto the first conveying device 51 and transported by the latter to the first transfer point 63 at the second conveying device 53, which is still located outside the high-voltage area 8. Through the use of a device at the transfer point 63, the cartridge 7 is moved from the first conveying device 51 to the first position 52 on that workpiece 61 which is subsequently painted with the paint from this cartridge 7, onto the second conveying device 53. The second conveying device 53 therefore transports the workpieces 61 and the associated cartridges 7 into the high-voltage area to the acceptance point 40 at the paint application device 4. The first position 52 is provided at the front, in the direction of movement, and if possible at a point which moves into the acceptance point 40 first.

There, the cartridge 7 is taken from the first position 52 as early as possible by a device and moved to the paint application device 4, and is also inserted into a metering device 38, 39 and connected to the spray heads 41, 42.

In the meantime, the workpiece 61 to be painted is transported onwards as far as a point at which it is painted. During the painting operation, the next workpiece 61 moves a cartridge 7 which is present there from the first position to the paint application device 4 and it inserts it into the currently inactive metering device 38, 39.

If the next workpiece is then to be painted, the color lines to and the spray heads 41, 42 themselves are cleaned or flushed, and the cartridge 7 in the inactive metering device 38, 39 is connected to the spray heads 41, 42. The next workpiece is then painted, and the completely or partly emptied cartridge 7 is moved out of the metering device 38, 39 to an output point 44 by a device.

There, it is moved to a second position 54 on the second conveying device 53, which is allocated to the workpiece 61 just painted. The second position 54 is provided after the workpiece in the direction of movement. The cartridge 7 is therefore advantageously returned to the workpiece 61, or moved onto the second transport device 53, at the latest possible time.

The completely or partly emptied cartridge 7, together with the painted workpiece 61, is transported out of the high-voltage area 8 as far as a second transfer point 65. There, the cartridge 7 is removed from the second position 54 by a device and moved onto the third conveying device. The latter transports it back to the loading station 2, and it is removed from the third conveying device 55 by a device allocated to each loading place 27. The completely or partly empty cartridge 7 is then flushed and is kept ready for reuse.

Figure 2:
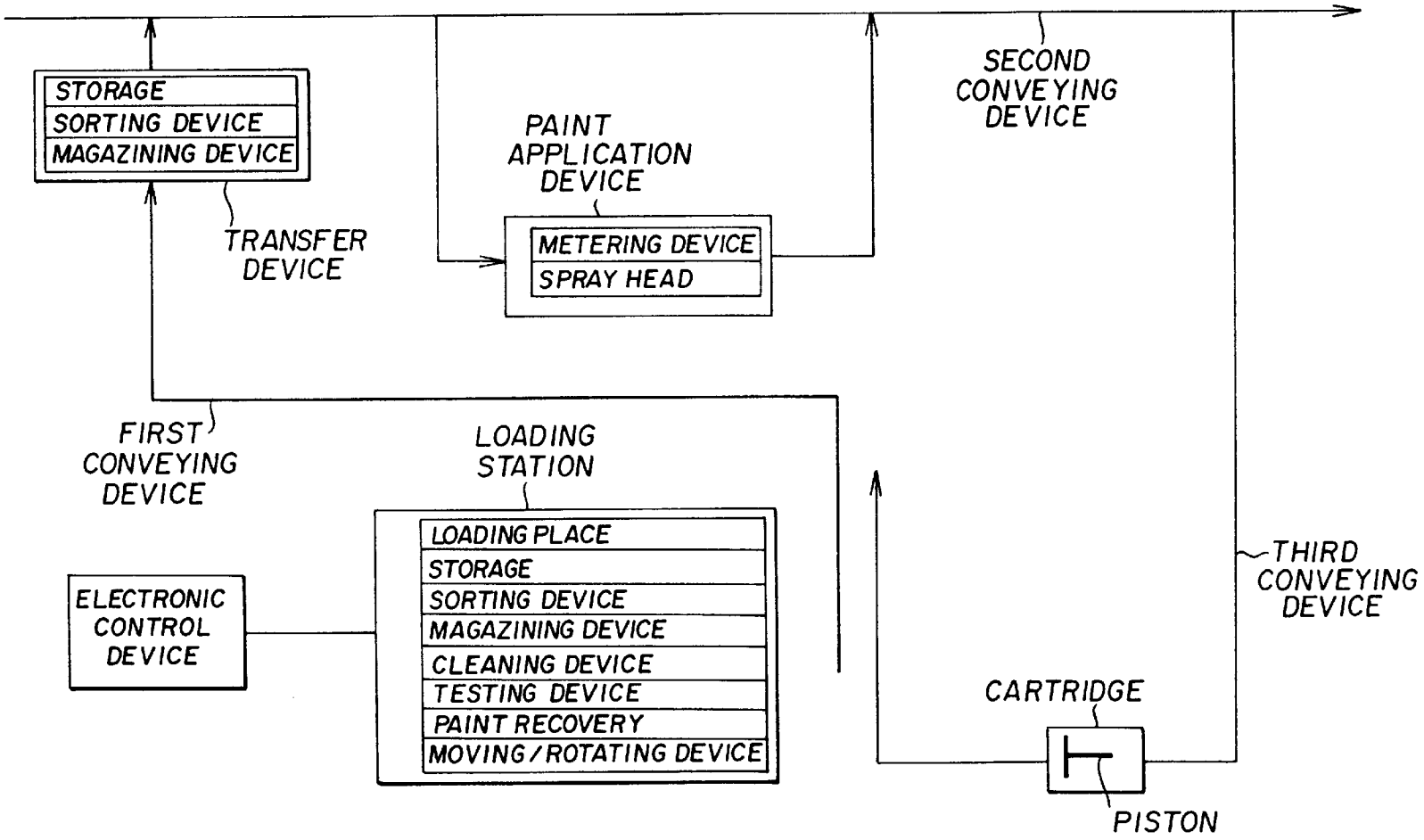
FIG. 2 is a block diagram of the configuration for transporting electrically conductive paint according to the invention.

FIG. 2 is a block diagram of the configuration for transporting electrically conductive paint and schematically illustrates some advantageous features of the invention. A loading station is provided at a location at ground potential. The loading station includes among other elements a loading place for loading cartridges, a storage for storing cartridges, a device for sorting the cartridges, a device for magazining the cartridges, a device for cleaning the cartridges, a device for testing and checking the cartridges for damage, a device for recovering unused paint, and a device for moving and or rotating the cartridges.

A paint application device is at a high voltage potential and includes at least a spray head for applying paint onto a workpiece and a device for metering the paint. The first conveying device transports cartridges from the loading station to a transfer device which transfers the cartridges to the second conveying device. The transfer device includes a devices for storing, sorting and magazining the cartridges. The third conveying device transports the at least partly emptied cartridges back to the loading station. An electronic control device controls the paint transport. As schematically illustrated each of the cartridges is equipped with a movable piston for accommodating a given paint volume.

We claim:

1. A method of transporting electrically conductive paint, the method which comprises:

filling a required quantity of an electrically conductive paint into a cartridge at a location at ground potential, the location at ground potential serving as a loading station;

transporting the cartridge filled with the electrically conductive paint with a first conveying device to a second conveying device;

transporting the cartridge filled with the electrically conductive paint with the second conveying device to at least one paint application device at a high potential;

connecting, at the at least one paint application device, the cartridge to at least one spray head provided at the at least one paint application device;

transporting an at least partly emptied cartridge with the second conveying device to a third conveying device;

transporting the at least partly emptied cartridge with the third conveying device back to the loading station;

filling a further cartridge at the location at ground potential; and conveying the further cartridge with the first conveying device.

2. The method according to claim 1, which comprises filling the further cartridge at the location at ground potential while transporting the at least partly emptied cartridge back to the location at ground potential.

3. The method according to claim 1, which comprises:

removing the cartridge filled with the electrically conductive paint from the second conveying device by using a moving device;

moving the cartridge filled with the electrically conductive paint to the at least one paint application device; and moving the at least partly emptied cartridge from the at least one paint application device onto the second conveying device by using one of the moving device and a further moving device.

4. The method according to claim 1, which comprises:

transferring a filled cartridge for each of a plurality of workpieces and for each of the at least one paint application device to a first position in the second conveying device; and transferring an at least partly emptied cartridge to a second position in the second conveying device.

5. A configuration for transporting electrically conductive paint, comprising:

a loading station configured for loading cartridges to be used for transporting paint, said loading station being a location at ground potential;

a paint application device at a high potential;

a first conveying device operatively connected to said loading station;

a second conveying device operatively connected to said first conveying device;

a third conveying device operatively connected to said second conveying device;

said first conveying device being configured for conveying filled cartridges from said loading station to said second conveying device;

said second conveying device being configured for conveying the filled cartridges to said paint application device, and for conveying at least partly emptied cartridges from said paint application device to said third conveying device;

said third conveying device being configured for conveying the at least partly emptied cartridges to said loading station; and an electronic control device, operatively connected to at least one of said first conveying device, said second conveying device, said third conveying device, said loading station, and said paint application device, for at least partly controlling a paint transport.

6. The configuration according to claim 5, wherein said loading station has at least one loading place connected to said first conveying device and said third conveying device, a filling device for filling cartridges, and a loading/unloading device for inserting cartridges into said first conveying devices and removing cartridges from said third conveying device.

7. The configuration according to claim 5, including:

a reservoir connected to said loading station; and said loading station having devices for storing and sorting filled cartridges, for magazining cartridges, for cleaning at least partly emptied cartridges, for testing cartridges for damage, for conveying residual paint back into said reservoir, for taking back at least partly emptied cartridges, and for one of rotating and moving cartridges.

8. The configuration according to claim 7, wherein said reservoir is a spur line.

9. The configuration according to claim 5, including:

a reservoir connected to said loading station; and said loading station having a loading place with devices for storing and sorting filled cartridges, for magazining cartridges, for cleaning at least partly emptied cartridges, for testing cartridges for damage, for conveying residual paint back into said reservoir, for taking back at least partly emptied cartridges, and for one of rotating and moving cartridges.

10. The configuration according to claim 9, wherein said reservoir is a spur line.

11. The configuration according to claim 5, wherein said first conveying device, said second conveying device, and said third conveying device are continuous conveyors for transporting the cartridges.

12. The configuration according to claim 5, wherein said first conveying device, said second conveying device, and said third conveying device are intermittent conveyors, said intermittent conveyors perform a conveying operation only on demand when a cartridge is to be conveyed.

13. The configuration according to claim 5, wherein said first conveying device, said second conveying device, and said third conveying device are a combination of continuous conveyors and intermittent conveyors.

14. The configuration according to claim 5, wherein said second conveying device is a transport device for transporting workpieces.

15. The configuration according to claim 5, wherein said second conveying device includes workpiece carriers.

16. The configuration according to claim 5, including:

at least a further paint application device;

said second conveying device transporting workpieces and having a first position per each of the workpieces and per each of said paint application device and said further paint application device;

said second conveying device further having a second position per each of the workpieces and per each of said paint application device and said further paint application device; and said first position being provided for a filled cartridge, said second position being provided for an at least partly emptied cartridge.

17. The configuration according to claim 16, wherein:

said paint application device has a transfer device for transferring cartridges to and from said second conveying device, said first position and said second position respectively disposed in proximity to said transfer device when transferring the cartridges; and said second conveying device defines a transport direction, said first position is, as seen in the transport direction, in front of said second position.

18. The configuration according to claim 5, including a transfer device defining a transfer point for transferring cartridges from said first conveying device to said second conveying device.

19. The configuration according to claim 18, including at least one device selected from the group consisting of a storing device for storing cartridges, a sorting device for sorting cartridges, and a magazining device for magazining cartridges, said at least one device being disposed at said transfer point.

20. The configuration according to claim 5, wherein said paint application device has at least one metering device for conveying paint out of a cartridge.

21. The configuration according to claim 5, wherein said paint application device has at least one transfer device for transferring cartridges from said second conveying device to said paint application device.

22. The configuration according to claim 5, wherein said paint application device has at least one transfer device for transferring cartridges from said paint application device to said second conveying device.

23. The configuration according to claim 5, including:

a first transfer device defining a first transfer point for transferring cartridges from said first conveying device to said second conveying device; and a second transfer device defining a second transfer point for transferring cartridges from said second conveying device to said third conveying device.

24. The configuration according to claim 5, wherein said second conveying device is operated such that cartridges are transferred to said second conveying device in a sequence corresponding to a sequence of use during an application of paint.

25. The configuration according to claim 5, wherein said electronic control device is an automatic control device for coordinating a paint selection, color sequences, and operation sequences for at least one of said loading station, said first conveying device, said second conveying device, and said third conveying device.

26. The configuration according to claim 5, wherein said electronic control device operates based on a fuzzy logic.

27. The configuration according to claim 5, wherein said electronic control device takes into account service lives of paints of different colors in respective cartridges and optimizes an operation sequence based on the service lives.

28. The configuration according to claim 5, wherein said electronic control device is a component in an overall control device for controlling a supplying of the paint.

29. The configuration according to claim 5, wherein said electronic control device is configured for performing an overall control.

30. The configuration according to claim 5, wherein said electronic control device learns and adapts parameters automatically based on operating data collected and evaluated during an operating time.

31. A configuration for transporting electrically conductive paint, comprising:

cartridges for transporting paint, said cartridges having respective pistons, said pistons being movable to respective positions in said cartridges for matching respective paint volumes in said cartridges;

a loading station configured for loading said cartridges to be used for transporting paint, said loading station being a location at ground potential;

a paint application device at a high potential;

a first conveying device operatively connected to said loading station;

a second conveying device operatively connected to said first conveying device;

a third conveying device operatively connected to said second conveying device;

said first conveying device being configured for conveying filled ones of said cartridges from said loading station to said second conveying device;

said second conveying device being configured for conveying said filled ones of said cartridges to said paint application device, and for conveying at least partly emptied ones of said cartridges from said paint application device to said third conveying device;

said third conveying device being configured for conveying said at least partly emptied ones of said cartridges to said loading station; and an electronic control device, operatively connected to at least one of said first conveying device, said second conveying device, said third conveying device, said loading station, and said paint application device, for at least partly controlling a paint transport.

32. The configuration according to claim 31, wherein each of said cartridges is assigned a unique identification code.

* * * * *

UNITED STATES PATENT AND TRADEMARK OFFICE

CERTIFICATE OF CORRECTION

PATENT NO. : 6,401,768 B2
DATED : June 11, 2002
INVENTOR(S) : Joachim Lichte et al.

It is certified that error appears in the above-identified patent and that said Letters Patent is hereby corrected as shown below:

Title page,
Item [30], should read as follows:
-- [30] Foreign Application Priority Data
Aug. 26, 1999 (DE) …….. 199 40 541.7 --

Signed and Sealed this

Seventeenth Day of December, 2002

JAMES E. ROGAN
*Director of the United States Patent and Trademark Office*